US012129668B2

(12) United States Patent
Boschian

(10) Patent No.: US 12,129,668 B2
(45) Date of Patent: Oct. 29, 2024

(54) DISTRIBUTION DEVICE AND METHOD FOR DISTRIBUTING ADHESIVES ON PLATES

(71) Applicant: FABOTEC GMBH, Stans (CH)

(72) Inventor: Flavio Boschian, Stans (CH)

(73) Assignee: Fabotech GmbH, Stans (CH)

( * ) Notice: Subject to any disclaimer, the term of this patent is extended or adjusted under 35 U.S.C. 154(b) by 788 days.

(21) Appl. No.: 17/266,165

(22) PCT Filed: Aug. 6, 2019

(86) PCT No.: PCT/EP2019/071155
§ 371 (c)(1),
(2) Date: Feb. 5, 2021

(87) PCT Pub. No.: WO2020/030658
PCT Pub. Date: Feb. 13, 2020

(65) Prior Publication Data

US 2021/0310260 A1 Oct. 7, 2021

(30) Foreign Application Priority Data

Aug. 7, 2018 (EP) ..... 18187732

(51) Int. Cl.
*E04F 21/00* (2006.01)
*E04F 21/02* (2006.01)

(52) U.S. Cl.
CPC ..... *E04F 21/023* (2013.01)

(58) Field of Classification Search
CPC ..... E04F 21/023
See application file for complete search history.

(56) References Cited

U.S. PATENT DOCUMENTS 2,329,378 A * 9/1943 Kuehner ..... B05C 3/18 118/423
4,967,689 A * 11/1990 Wittmann ..... B05C 11/04 118/428

FOREIGN PATENT DOCUMENTS

| | | |
|---|---|---|
| BE | 682 328 | 11/1966 |
| CN | 107327125 A | 11/2017 |
| DE | 37 26 841 A1 | 2/1989 |
| FR | 2 702 972 A1 | 9/1994 |
| WO | 2005/026468 A1 | 3/2005 |

OTHER PUBLICATIONS

International Search Report Corresponding to PCT/EP2019/071155 mailed Sep. 20, 2019.
Written Opinion Corresponding to PCT/EP2019/071155 mailed Sep. 20, 2019.

* cited by examiner

*Primary Examiner* — Hai Y Zhang
(74) *Attorney, Agent, or Firm* — Finch & Maloney PLLC

(57) ABSTRACT

A distributing device (10) for distributing liquid, pasty or viscous adhesives on plates, in particular adhesive sides of plates, and more preferably tiles which may comprise different sizes. The distributing device (10) comprises a base element (11) and two guide elements (13), such as lateral guide elements (13), for guiding the plates. The distributing device (10) comprises a distributing element (12) for distributing the adhesive on the plates. The distributing element (12) is directly or indirectly connected or connectable to the base element (11). The distributing device (10) comprises a receiving area (14), a guiding area (15) and a removal area (16) for receiving, guiding and removing the plates.

15 Claims, 2 Drawing Sheets

DISTRIBUTION DEVICE AND METHOD FOR DISTRIBUTING ADHESIVES ON PLATES

This application is a National Stage completion of PCT/EP2019/071155 filed Aug. 6, 2019, which claims priority from European patent application serial no. 18187732.5 filed Aug. 7, 2018.

FIELD OF THE INVENTION

The present invention relates to a distributing device for distributing adhesives on plates and a method for distributing adhesives on plates.

BACKGROUND OF THE INVENTION

Nowadays, it is common practice to apply adhesive to each tile with a trowel when laying tiles on walls and floors. This process is laborious and lengthy. Therefore, efforts have already been made to simplify the process with distributing devices.

Such a distributing device is known from CN 107327125. The distributing device comprises a table, a base element and a square container with a movable steering plate. The steering plate adjusts the size of the lower opening of the container to the size of the plate. The adhesive is filled into the square container and this is guided over the plates to be provided with adhesive. Two angle steels can be used to guide the container. The disadvantage of this prior art is that the distributing device requires a lot of space and has a complex structure.

SUMMARY OF THE INVENTION

It is the task of the invention to remedy these and other disadvantages of the prior art. In particular, a distributing device for simple and rapid distribution of adhesives on tiles, plates, mineral wool or similar materials and a method for rapid and simple distribution of adhesives are to be provided. The task is solved by a distributing device and a method according to the independent claims. Therefore, the purpose of the distributing device is to quickly and easily provide plates, tiles, mineral wool or other solid materials with a layer of adhesive so that they can be laid on a wall or floor.

In particular, the task is solved by a distributing device for distributing liquid, pasty or viscous adhesives on plates, in particular on adhesive sides of plates, preferably tiles, in particular preferably tiles of different sizes. The distributing device comprises a base element and two guide elements, in particular lateral guide elements, for guiding the plates. The distributing device comprises a distributing element for distributing the adhesive on the plates. The distributing element is in particular directly or indirectly connected or connectable to the base element. The distributing device comprises in particular a receiving area, a guiding area and a removal area for receiving, guiding and removing the plates.

With such a distributing device, liquid, pasty or viscous adhesive can be easily and quickly distributed onto plates. In the context of the present invention, plates refer to materials that are less high than wide and, in particular, have a width that is substantially between 10 mm and 3550 mm. This includes all types of tiles, in particular earthenware, stoneware, fine stoneware, glass, cement-bonded or resin-bonded artificial stone, natural stone, terracotta, clinker, split clinker, brick, wood, parquet, plastic, chrome steel, aluminum, steel or laminate tiles. Further, this also includes EPS or XPS plates, sheets, for example steel, copper or aluminum sheets, or mineral wool.

The guide elements are designed in particular as metal plates, which preferably comprise an inclined surface to the removal area. However, other guide elements could also be used, such as rollers, rails, angle bars or other suitable elements.

The base element is preferably a base plate, in particular a base plate made of metal. A grid or other suitable elements that enable the plates to be provided with adhesive to be guided can also be used. The base element may include rollers or other suitable guide elements. The base element may comprise a narrowing in the removal area.

The distributing element is preferably a distributing plate, by means of which the adhesive can be distributed, in particular stripped, on a plate. In particular, the distributing element is connected to the guide elements. Alternatively, the distributing element may be connected to the base element. The distributing element is preferably arranged on the inclined surface of the guide elements. In particular, the connection between the distributing element and the distributing device is detachable. In particular, the connection between the distributing element and the distributing device is a screw connection. Other types of connection, such as click, key, bolt or pin connections can also be used.

The various sections are arranged in the feed-through direction. The feed-through direction leads from one end of the base element to the other end, in the direction along which the plates are fed through the distributing device. In the feed-through direction as first the receiving area is arranged, as second the guiding area and as last the removal area.

Preferably, the distributing element or at least a part of the distributing element is arranged at a distance from the base element. In particular, the distance is adjustable. In particular, the distance is preferably adjustable between 10 mm and 600 mm.

This allows easy adjustment to the height of the plates and the necessary thickness of the adhesive layer.

Preferably, each guide element comprises at least one fastening element, in particular a groove, for fastening the distributing element, in particular for fastening the distributing element in a first and a second fastening position.

This allows easy connection of the distributing element to the guide elements. The fastening element may comprise a groove, a bore or other suitable fastening means.

The distributing element may comprise a wiper element. In particular, the wiper element may comprise a wiper profile.

The wiper element enables easy wiping of adhesives. The wiper profile enables easy distribution of adhesives. The distributing element may comprise a retaining element to which the wiper element is connected. In particular, the connection between the wiper element and the retaining element can be detachable. If the connection between the wiper element and the distributing element is detachable, other wiper profiles can be used, which makes maintenance easier. Different wiper profiles or the same wiper profiles can be used. The wiper element can be made of plastic. The plastic can be elastic or hard. Hard rubber or polypropylene can be used. The wiper profile may include serrations, edges, ribs, prongs, nubs, or other suitable profile elements. The wiper profile may be metal or plastic such as hard rubber or polypropylene.

Preferably, the guide elements are arranged substantially parallel to each other.

This facilitates an operation of the distributing device, i.e. a passage of the plates through the distributing device. The guide elements may be arranged to be at least partially tapered in the feed-through direction.

The distributing device may comprise pressing elements, in particular springs, for pressing at least one guide element against the plates to be provided with adhesive.

This improves the seal between the guide elements and the plate. However, the pressing elements may also comprise screws, hydraulic, pneumatic or other suitable elements by means of which the guide elements can be pressed against the plates.

Preferably, the base element comprises at least one fastening element, in particular preferably two fastening elements. This at least one fastening element comprises in particular a groove for fastening a guide element, in particular preferably two guide elements, in particular for fastening a guide element in a first and in a second fastening position. By means of the at least one fastening element, the guiding area is adaptable to the plate size, in particular to plates of the size between 30 mm and 3500 mm.

This allows easy adaptation to the most commonly used sizes of plates. The fastening element can be as a groove, hole or other suitable fastening element. There may be several of the same and/or different fastening elements.

Preferably, the guiding area is between 45 mm-4500 mm long, in particular substantially 1000 mm long.

This enables easy sliding through of one plate with another plate.

Preferably, the base element is between 100 mm and 800 mm wide in the removal area, more preferably substantially 600 mm wide.

This makes it easy to remove the plates provided with adhesive from the distributing device.

The distributing device can comprise at least one fastening device for fastening the distributing device, wherein this at least one fastening device is arranged in particular such that the distributing device can be fastened to vertical or horizontal support elements in a fastening position.

This makes it easy to work on scaffolds. The fastening device can in particular be arranged on a side of the base element opposite the guiding area. However, it can also be arranged on another side of the base element. It may comprise various fastening elements, such as clamps, click or screw connections or other suitable fastening elements. The fastening position may define a substantially horizontal or vertical orientation of the feedthrough direction. Alternatively or additionally, the distributing device may comprise a rack. The rack may include casters for transporting the distributing device. The height of the rack may be adjustable, in particular between 500 mm and 1300 mm. This makes it easier to operate the distributing device. The distributing device can be easily transported using a frame with castors. The distributing device can be operated more easily by a user in different postures.

The distributing device can comprise a plate feeding device for feeding the plates into the distributing device, in particular into the receiving area of the distributing device.

A plate feeding device is used to quickly bring the plates into the distributing device.

The plate feeding device may comprise rollers for moving the plates.

This allows the plates to be moved easily.

The receiving area may include at least one directing element for easy insertion of plates.

This allows the distributing device to be easily operated. This directing element may comprise, for example, an inclined surface or a rounding of the directing elements at the receiving area, rollers or other suitable elements that facilitate an introduction of plates into the receiving area.

Preferably, the guiding area of the distributing device is defined by the base element and the guide elements, in particular the base surface G of the guide elements. In particular, the guiding area is designed for receiving and holding adhesives.

This makes the structure of the distributing device simpler, since no additional container is required.

The distributing device can comprise at least one protective element, in particular film or coating, for protecting easily scratchable surfaces of plates.

This makes it possible to carry out the distribution of the adhesive quickly and safely. The protective element may comprise plastic protective elements such as films, foam rubber or felt materials, or other suitable protective elements such as wool or sponges.

The guiding area may comprise a feeding device, in particular a current-driven feeding device, for moving the plates.

This allows the adhesive to be distributed quickly and easily on the plates. The advance device can be driven by electricity, with or without a cable, by hand, with a hand crank, with a pedal drive or in any other suitable way.

The distributing device, in particular the removal area of the distributing device, may comprise a cleaning device for cleaning the visible side of the plates opposite the adhesive side. In particular, the cleaning device may comprise a sponge and/or a water supply for cleaning plates.

This allows the plates to be cleaned cleanly and quickly. The cleaning device may include a supply for soaps, alcohols or other suitable solvents or cleaning agents. The cleaning device may include one or more natural or plastic sponges. The one or more sponges may have a rough surface or a soft surface.

The distributing device may comprise an introducing device for introducing adhesives into the distributing device, in particular into the guiding area of the distributing device.

This simplifies the introduction of adhesives and makes it faster. The introduction device may include a nozzle, a hose, a pump, a kettle with a top opening and a bottom opening, or other suitable elements.

The Distributing device may include a vibrating device for adhesive compaction.

This makes the distribution of the adhesive more uniform. The vibration frequency may be adjustable.

Further, the problem is solved by a method for distributing adhesives. In particular, the task is solved by a method for distributing adhesives by means of a distributing device according to any of the claims, comprising the steps:

Insertion of a first plate into a distributing device, in particular into a receiving area of a distributing device Filling adhesive into the distributing device, in particular into a guiding area of a distributing device Passing the first plate through the distributing device, in particular by pushing it through, in particular preferably by pushing it through with another plate, the adhesive being distributed on the plate by a distributing element when the plate is passed through, the adhesive layer having in particular a predefined thickness.

Removal of the first plate from the distributing device, in particular from the removal area of the distributing device.

This process enables easy and simple distribution of adhesive on plates. In the process, the adhesive layer can be evenly distributed. The predefined thickness of the adhesive layer can be different at different points of the layer. The adhesive layer may have grooves, furrows or other profiles. The plates can be fed through a feeding device or manually through the distributing device. Adhesives may be stirred prior to filling. Adhesives may be added after each plate is removed or after multiple plates are removed. For the process, plates, all kinds of tiles, in particular stoneware, stoneware, fine stoneware, glass, cement-bonded or resin-bonded artificial stone, natural stone, terracotta, clinker, split clinker, brick, wood, parquet, plastic, chrome steel, aluminum, steel or laminate tiles can be used, as well as EPS or XPS plates, sheets, for example steel, copper or aluminum sheets, or mineral wool.

During the process, the additional plate can be pierced by a third plate.

This makes it easy to apply adhesive to multiple plates.

The thickness of the adhesive layer can be changed by moving the distributing element from a first to a second fastening position.

This allows easy adjustment to the height of the plates and the necessary thickness of the adhesive layer.

First, the width of the guiding area can be adjusted to the width of the plates to be provided with adhesive by moving at least one guide element from a first to a second fastening position.

This allows easy adaptation to the plates to be used.

BRIEF DESCRIPTION OF THE DRAWINGS

An embodiment of a distributing device is exemplified with reference to the following figures. They show.

DETAILED DESCRIPTION OF THE PREFERRED EMBODIMENTS

Figure 1:
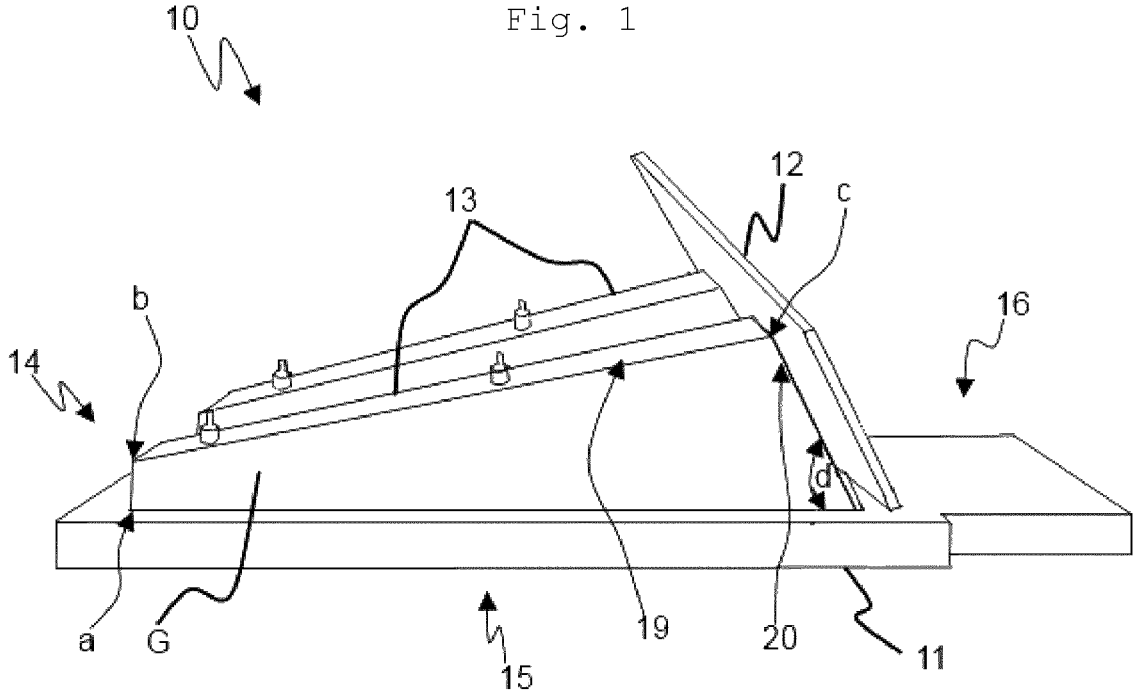
FIG. 1: Perspective view of a distributing device.

FIG. 1 shows a perspective view of a distributing device 10. The distributing device 10 has a length of 600 mm and a width of 450 mm and is made of chromium steel. The distributing device 10 comprises three main elements: a base element, in this case a base plate 11, two guide elements 13 and a distributing element 12. The distributing device 10 also comprises three areas: A receiving area 14, a guiding area 15, and a removal area 16. The areas are arranged along a feed-through direction D. The feedthrough direction D is the direction from one end of the base element 11 to the other end of the base element 11 parallel to an axis of symmetry L (cf. FIG. 3). The receiving area 14 is arranged first in the feed-through direction D, followed by the guiding area 15, which essentially corresponds to the area between the guide elements 13, and this is followed by the removal area 16.

Figure 3:
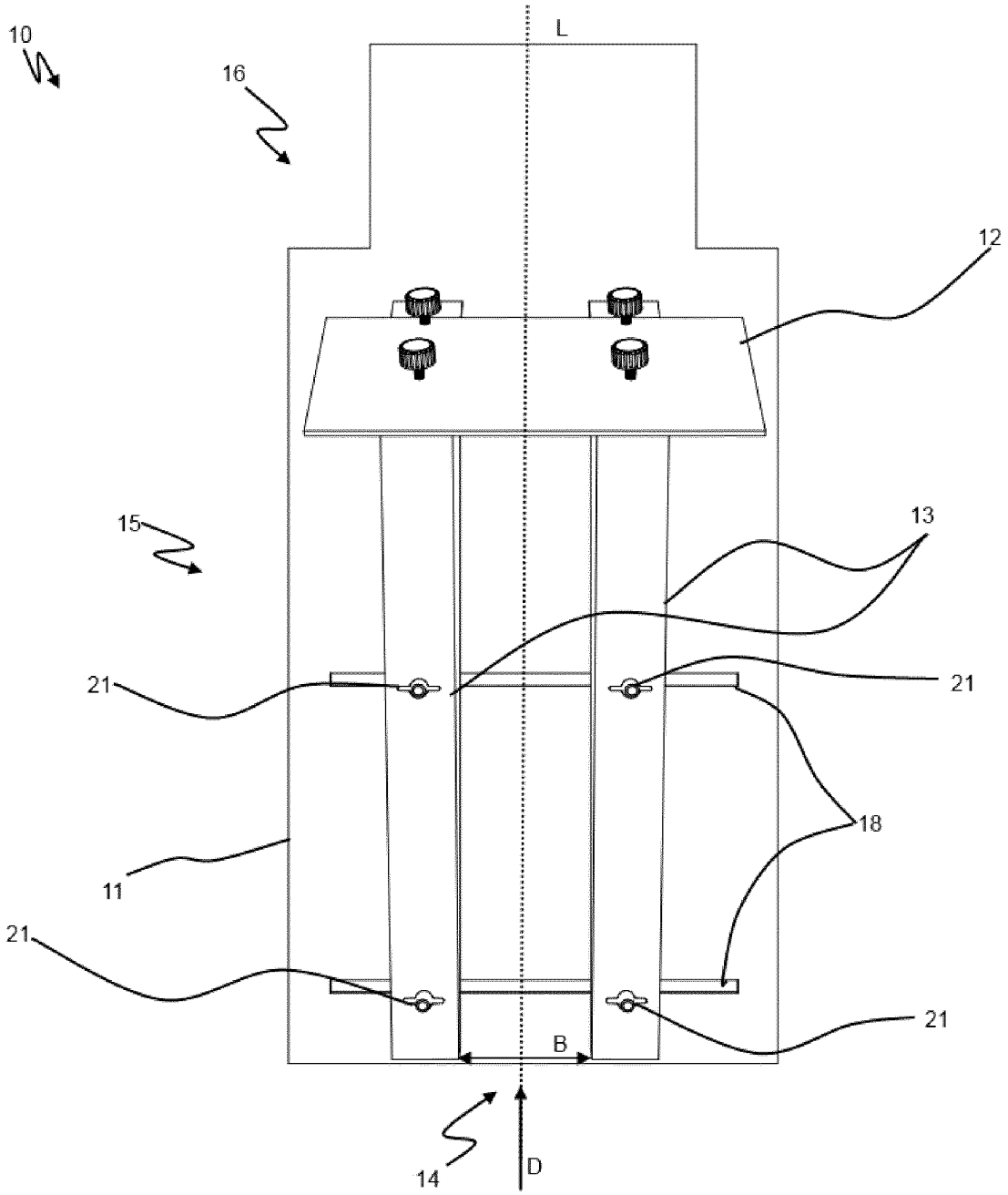
FIG. 3: Top view of a distributing device

The guide elements 13 are arranged on the base plate 11, whereby they are arranged parallel to each other and to the axis of symmetry L (cf. FIG. 3).

The guide elements 13 are here plates having a base surface G. The base surface G has a substantially quadrangular shape. The base surface G comprises substantially a right angle a, two obtuse angles b, c and an acute angle d, so that no side of the base surface G is parallel to or equal in length to another. The shortest side of the base surface G is arranged at a right angle a to the longest side. The second longest side is arranged at an obtuse angle b to the shortest side. The second shortest side is arranged to the two longer sides such that it forms an acute angle d to the longest side and an obtuse angle c to the second longest side.

The bases G are arranged substantially on one side of the base plate 11 such that the longest side of the base G is parallel to the axis of symmetry L and the shortest side leads away from the side of the base plate 11 at a right angle. This results in a shorter, steeper ramp 20 and a longer, flatter ramp 19. The shorter ramp 20 is arranged to lead down to the removal area 16. The longer ramp 19 is arranged to lead down to the receiving area 14. Grooves are arranged on the surface of the shorter ramp 19. The distributing element 12 is arranged on the shorter ramp 19.

Figure 2:
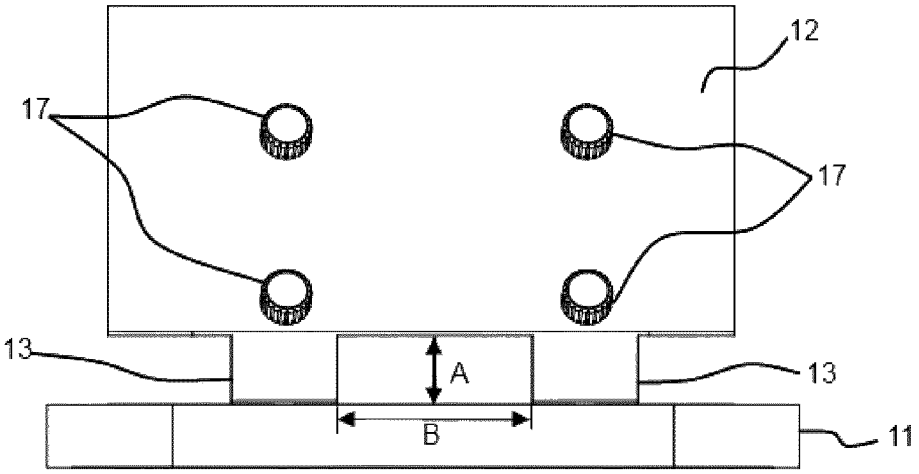
FIG. 2: Front view of a distributing device

FIG. 2 shows a front view of the distributing device 10 of FIG. 1. The distributing element 12 is a substantially rectangular plate having four holes. The distributing element 12 is arranged on the guide elements 13 in such a way that there is a distance A between the base plate 11 and the distributing element 12. This distance A is the height of an opening arranged between the base plate 11, the distributing element 12 and the guide elements 13.

The distributing element 12 is connected to each guide element 13 by means of two screws 17.

FIG. 3 shows a top view of the distributing device from the previous figures. The base plate 11 is mirror symmetrical to an axis of symmetry L, the axis of symmetry L being parallel to the longest edges of the base plate 11. On the side of the removal area 16 at the end of the base plate 11, both corners of the base plate 11 are stepped by 50 mm×100 mm, so that this end of the base plate 11 is less wide than the rest of the base plate 11, making it easier to remove the adhesive-coated plates.

The base plate 11 comprises two opposite sides. On one side there are two grooves 18 which are perpendicular to the line of symmetry L and parallel to each other. These allow the guide elements 13 to be connected to the base plate 11. Each guide element 13 is connected to these grooves 18 of the base plate 11 by two wing screws 21. By loosening the wing screws 21, moving a guide element 13 and fastening the wing screw 21, the width B of the guiding area 15 can be increased or decreased.

When spreading adhesive on plates, first both distance A and width of guiding area 15 are adjusted to the size of the plate. Then, a first plate is inserted into the receiving area 14 of the distributing device 10. An adhesive is introduced into the guiding area 15. Another plate is used to push the first plate through the guiding area 15 and through the opening between the distributing element 12 and the base plate 11, causing the adhesive to spread and be wiped off the first plate. The first plate can be removed. The process can now be continued by pushing the further plate through a third plate through the distributing device 10.

The invention claimed is:

1. A distributing device for distributing liquid, pasty or viscous adhesives on plates, comprising:

a base element, and two guide elements, for guiding the plates, wherein the distributing device comprises a distributing element for distributing the adhesive on the plate, and the distributing element is connected or connectable, directly or indirectly, to the base element, the distributing device comprising a receiving area, a guiding area and a removal area for receiving, guiding and removing the plates, wherein on the side of the removal area at the end of the base element, two corners of the base element are stepped, so that this end of the base element is less wide than the rest of the base element, making it easier to remove the adhesive-coated plates.

2. The distributing device according to claim 1, wherein the distributing element, or at least a part of the distributing element, is arranged at a distance from the base element.

3. The distributing device according to claim 2, wherein the distance is adjustable.

4. The distributing device according to claim 1, wherein the distributing device comprises at least one fastening element for fastening the distributing element.

5. The distributing device according to claim 4, wherein the fastening element enables fastening of the distributing element in a first fastening position and a second fastening position.

6. The distributing device according to claim 1, wherein the distributing element comprises a wiper element.

7. The distributing device according to claim 1, wherein the guide elements are arranged substantially parallel to each other.

8. The distributing device according to claim 1, wherein the distributing device comprises pressing elements for pressing at least one guide element against the plates to be provided with adhesive.

9. The distributing device according to claim 1, wherein the base element comprises at least one fastening element for fastening at least one guide element, wherein the guiding area can be adapted to the size of the plates by the fastening element.

10. The distributing device according to claim 9, wherein the guide area can be adapted, by the at least one fastening element, to a size of the plates ranging between 1.18 inches-137.80 inches (30 mm and 3500 mm).

11. The distributing device according to claim 1, wherein a length of the guiding area is between 1.77 inches-177.17 inches (45 mm-4500 mm).

12. The distributing device according to claim 1, wherein a width of the base element is between 0.39 inches-137.01 inches (10 mm and 3480 mm in a removal area.

13. The distributing device according to claim 1, wherein a receiving area comprises at least one directing element for easy insertion of the plates.

14. The distributing device according to claim 1, wherein the guiding area of the distributing device is defined by the base element and the guide elements, and the guiding area is designed for receiving and holding adhesives.

15. The distributing device according to claim 1, wherein the distributing device comprises an introducing device for introducing adhesives into the distributing device.

* * * * *